US008529147B2

(12) United States Patent
Delage

(10) Patent No.: US 8,529,147 B2
(45) Date of Patent: Sep. 10, 2013

(54) APPLICATOR AND A PACKAGING AND APPLICATOR DEVICE INCLUDING SUCH AN APPLICATOR

(75) Inventor: Jean-Francois Delage, Clamart (FR)

(73) Assignee: L'Oreal, Paris (FR)

( * ) Notice: Subject to any disclaimer, the term of this patent is extended or adjusted under 35 U.S.C. 154(b) by 2399 days.

(21) Appl. No.: 11/191,980

(22) Filed: Jul. 29, 2005

(65) Prior Publication Data

US 2006/0051155 A1 Mar. 9, 2006

Related U.S. Application Data

(60) Provisional application No. 60/601,605, filed on Aug. 16, 2004.

(30) Foreign Application Priority Data

Jul. 30, 2004 (FR) ..... 04 51750

(51) Int. Cl.
*A46B 11/00* (2006.01)

(52) U.S. Cl.
USPC ..... 401/127; 401/129

(58) Field of Classification Search
USPC ..... 401/126–130, 110–112, 116, 117, 401/55, 75, 79, 81, 82
See application file for complete search history.

(56) References Cited

U.S. PATENT DOCUMENTS

| | | | | |
|---|---|---|---|---|
| 4,428,388 | A | 1/1984 | Cassai et al. | |
| 4,533,271 | A * | 8/1985 | Sansevero | 401/29 |
| 4,922,934 | A | 5/1990 | Gatti | |
| 4,990,014 | A * | 2/1991 | O'Neill | 401/127 |
| 5,040,914 | A * | 8/1991 | Fitjer | 401/127 |
| 5,372,444 | A | 12/1994 | Lhuisset | |
| 5,556,216 | A * | 9/1996 | Mayesh | 401/127 |
| 5,690,441 | A * | 11/1997 | McManus | 401/127 |
| 5,937,871 | A | 8/1999 | Clay | |
| 6,145,514 | A | 11/2000 | Clay | |
| 6,164,857 | A * | 12/2000 | Wolfarth-Brooks et al. | 401/127 |
| 6,565,276 | B1 | 5/2003 | Diaz | |
| 6,872,020 | B2 * | 3/2005 | Epli | 401/127 |
| 2002/0195117 | A1 | 12/2002 | Bailly | |

FOREIGN PATENT DOCUMENTS

DE 199 50 665 A1 5/2000

* cited by examiner

*Primary Examiner* — Tuan N Nguyen
(74) *Attorney, Agent, or Firm* — Oliff & Berridge, PLC

(57) ABSTRACT

An applicator may include: an applicator member; a handle that is generally elongate along a longitudinal axis; and a drive mechanism arranged to transform an action, exerted by a user on a control member that is movable relative to the handle, into a turning movement of the applicator member relative to the handle. The control member may be movable in a direction that is substantially parallel to the longitudinal axis of the handle.

29 Claims, 3 Drawing Sheets

APPLICATOR AND A PACKAGING AND APPLICATOR DEVICE INCLUDING SUCH AN APPLICATOR

CROSS-REFERENCE TO RELATED APPLICATIONS

This non-provisional application claims the benefit of French Application No. 04 51750 filed on Jul. 30, 2004 and U.S. Provisional Application No. 60/601,605 filed on Aug. 16, 2004, the entire disclosures of which are incorporated herein by reference.

The present invention relates to applicators used in the field of cosmetics.

The invention relates more particularly, but not exclusively, to applicators for applying mascara onto eyelashes and/or eyebrows.

BACKGROUND

Makeup is conventionally applied onto eyelashes or eyebrows using an applicator member constituted by a brush or a comb. Further, makeup may be applied by turning such an applicator member about its axis.

Devices are disclosed in U.S. Pat. Nos. 4,922,934 and 5,937,871 that transform an action exerted on a pushbutton provided on a side of an applicator into a turning movement of the applicator member.

The amplitude of the turning movement of the applicator member in the applicator described in U.S. Pat. No. 5,937,871 is proportional to a depression stroke of the pushbutton.

An applicator is described in U.S. Pat. No. 6,145,514 that includes a knurled wheel that may be accessed through an opening provided on a side of a handle of the applicator. The knurled wheel enables the applicator member to be turned about its axis.

SUMMARY

In general, it is difficult to turn known applicators manually over more than one fourth of a turn. In the applicator described in U.S. Pat. No. 5,937,871, if a sufficient turning stroke is to be obtained, the pushbutton must either project substantially from the applicator, or else movement of the pushbutton must be geared up, making it harder to press, thereby making such an applicator less ergonomic and less attractive.

The applicator described in U.S. Pat. No. 4,922,934 is particularly complex and costly to make, requiring a mechanism that enables elastic energy to be accumulated before being released when the user presses on the pushbutton. From an ergonomic point of view, the applicator described in U.S. Pat. No. 6,145,514 is not completely satisfactory.

Thus, a need exists to improve applicators to enable the applicator member to be turned mechanically about its own axis.

Exemplary embodiments of the invention satisfy this need by providing an applicator comprising: an applicator member; a handle that is generally elongate along a longitudinal axis; and a drive mechanism arranged to transform an action, exerted by a user on a control member that is movable relative to the handle, into a turning movement of the applicator member relative to the handle; the control member being movable in a direction that is substantially parallel to the longitudinal axis of the handle.

Exemplary embodiments of the invention allow a displacement stroke of the control member to be increased without unduly harming usability or appearance of the applicator. For example, the control member may be configured to lie substantially on the axis of the handle.

In exemplary embodiments, a greatest displacement stroke of the control member may increase an amplitude of the turning movement imparted to the applicator member. For a turning movement of equivalent amplitude, a greatest displacement stroke of the control member may reduce a force that needs to be applied on the control member.

Exemplary embodiments of the invention may thus make it possible to improve at least comfort in application or quality of a makeup effect, for example, by enabling the user to work eyelashes and/or eyebrows more with the applicator member, foe example, to deposit a relatively large quantity of substance so as to obtain a heavily made-up effect, without however neglecting to comb and separate eyelashes.

In exemplary embodiments, the applicator member may be turned about its own axis, i.e., the applicator member may be moved in a volume of space that may remain stationary.

In exemplary embodiments, the applicator member may be turned about a longitudinal axis of the handle.

In exemplary embodiments, the control member may project from one end of the handle.

In exemplary embodiments, the applicator may include a stem that carries the applicator member at a first end.

In exemplary embodiments, the stem may be arranged to co-operate with a connection element connected to the control member.

In exemplary embodiments, the stem may be arranged to co-operate, for example, at a second end remote from the first end, with the connection element, so as to enable relative axial displacement between the connection element and the stem, with little relative turning between the connection element and the stem, for example, with substantially no relative turning.

For example, in exemplary embodiments, at the second end thereof, the stem may include a housing including an inside section that is not completely circular. A portion of the connection element may be engaged therein may also include a cross-section that is not completely circular. Thus, the control member may turn the stem by the connection element, which may be axially displaced relative to said stem.

For example, in exemplary embodiments, the connection element may be made integrally as a single piece with the control member. The connection element may thus be secured relative to the control member.

In exemplary embodiments, the control member and the handle may include portions in relief configured to co-operate so as to transform an axial movement of the control member into a turning movement of said control member. For example, the portions in relief may comprise at least one helical thread provided on the handle and at least one pin provided on the control member so as to become engaged with the thread. The turning movement of the applicator member may thus be proportional to a translation movement of the control member.

In exemplary embodiments, a slope of the thread and a stroke of the control member may be selected so that the applicator member performs between about 0.5 and about 2 turns, for example, about 1 turn, when the user presses on the control member and said control member is displaced through a maximum stroke thereof.

In exemplary embodiments, the connection element may not be made integrally as a single piece with the control member, but may nevertheless be secured to said control member, for example, by using fastener means configured so as to enable the connection element to turn relative to the control member, without any significant axial displacement between the connection element and the control member.

Thus, in exemplary embodiments, the control member may be axially displaced by the user without turning, thereby further improving comfort in application.

In such exemplary embodiments, for example, the connection element may be arranged to co-operate with the handle so that an axial displacement of the connection element is accompanied by said connection element turning relative to the handle, said turning movement being transmitted to the stem.

In exemplary embodiments, the stem may be advantageously assembled to the handle so as to be able to turn relative to said handle without being axially displaced along the longitudinal axis. For example, the stem may include an assembly skirt that is coaxial with the handle and that is snap-fastened in said handle so as to be freely turnable about the longitudinal axis inside the handle, without being axially displaced relative to said handle.

In exemplary embodiments, the applicator may advantageously include a resilient return member arranged to return the control member to an initial position when the user ceases to press thereon.

In exemplary embodiments, the return member may comprise a spring, for example, with at least part of said spring being mounted around the stem and/or the connection element, for example.

In exemplary embodiments, the spring may include a first end arranged to bear against a transverse wall that connects the assembly skirt to a remainder of the stem. The transverse wall may be configured to bear against a collar of a wiper member when a receptacle including a neck that is surmounted by the collar is closed by the applicator.

In exemplary embodiments, the applicator member may be made integrally as a single piece with the stem. Alternatively, in exemplary embodiments, the applicator member may be fastened onto the stem in a permanent or interchangeable manner.

For example, the applicator member may comprise at least one of a brush, a comb, a non-twisted brush, and a twisted brush.

Exemplary embodiments of the invention provide a packaging and applicator device, for applying a substance onto eyelashes or eyebrows, for example, said device comprising: a receptacle containing a substance; and an applicator as defined above.

In exemplary embodiments, the device may further include a wiper member configured to wipe the applicator member while the applicator is being removed from the receptacle.

Exemplary embodiments of the invention provide a method of applying makeup using an applicator as defined above, said method comprising: loading the applicator member with makeup; and turning the applicator member by pressing on the control member.

BRIEF DESCRIPTION OF THE DRAWINGS

The invention may be better understood on reading the following detailed description of non-limiting embodiments, and on examining the accompanying drawings, in which.

DETAILED DESCRIPTION OF EMBODIMENTS

Figure 1:
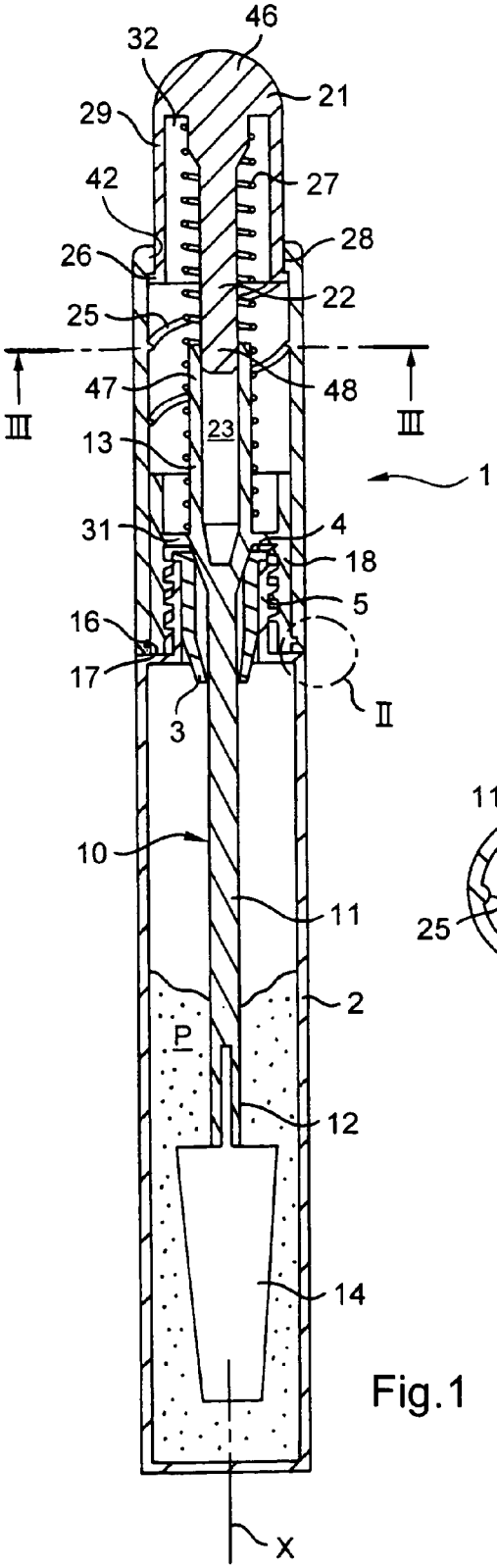
FIG. 1 is a diagrammatic and fragmentary longitudinal cross-sectional view of an exemplary embodiment of a device.

FIGS. 1 to 6 show an exemplary packaging and applicator device 1 comprising: a receptacle 2 containing a substance P, for example, a substance for being applied onto eyelashes and/or eyebrows, such as mascara; and an applicator 10 that is configured to be removed from the receptacle 2 during use.

In the exemplary embodiment, a top portion of the receptacle 2 may include a neck 5 containing a wiper member 3 including a collar 4 that comes to bear against the top end of the neck 5 and that may be configure to aid in sealing the receptacle 2 when closed.

The applicator 10 may include a stem 11 with a longitudinal axis X. The stem 11 may be provided at a first end 12 thereof with an applicator member 14 configured to take substance from the receptacle 2 and configured to apply substance onto eyelashes and/or eyebrows.

In the figures, the applicator member 14 is shown diagrammatically, and may, for example, comprise a twisted brush, for example, a brush including a core formed by a wire that has been folded into a U-shape and then twisted, with bristles being held between turns of the core.

Where appropriate or desired, the applicator member 14 may not include any metal, thereby enabling the applicator to be placed in a microwave oven, for example, provided that the other component elements are also not made of metal.

The applicator member 14 may thus include teeth or spikes that are made integrally, i.e., monolithically, with a support by molding a plastics material.

The applicator member 14 may be secured to the stem 11 in various ways, for example, by being fastened onto said stem, or by being made integrally as a single piece with said stem.

A top of the stem 11 may be connected to a handle 15 with a shape of a sleeve.

In the exemplary embodiment, the neck 5 is threaded on an outside thereof. The stem 11 may include an assembly skirt 18 that is threaded on an inside thereof so as to enable the assembly skirt 18 to be screwed on the neck 5.

The assembly skirt 18 may be connected to a remainder of the stem 11 by an annular-shaped transverse wall 31 that bears against the collar 4 of the wiper member 3 once the assembly skirt 18 is screwed home on the neck 5.

In the exemplary embodiment shown, the assembly skirt 18 may be disposed inside the handle 15, so as to be able to turn relative to said handle 15 about the axis X, without being displaced axially relative to said handle 15.

Figure 2:
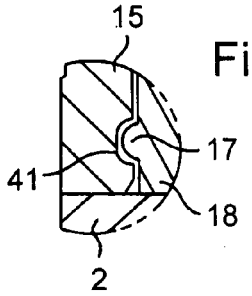
FIG. 2 shows a detail view II of FIG. 1.
Figure 3:
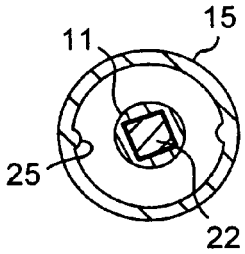
FIG. 3 is a diagrammatic cross-sectional view taken along III-III in FIG. 1.
Figure 4:
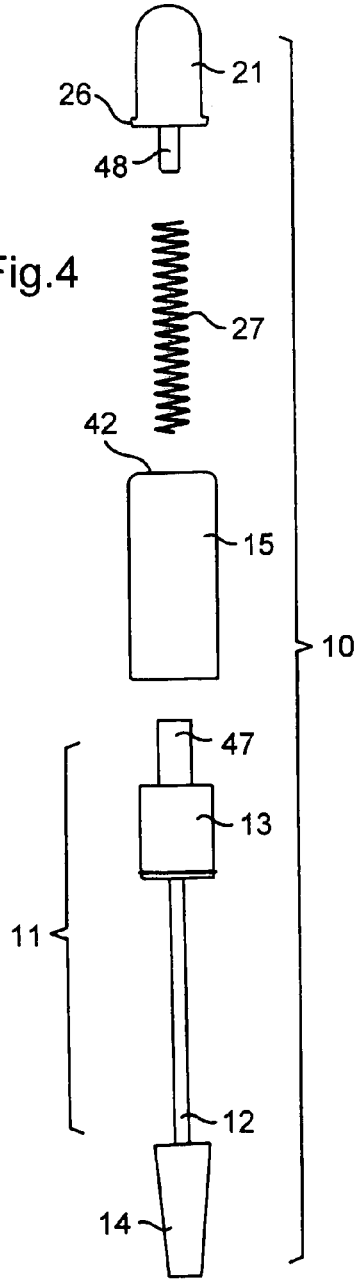
FIG. 4 is an exploded view of the device of FIG. 1.

For example, the assembly skirt 18 may be fastened inside the handle 15 by snap-fastening, as shown in FIG. 2, said handle 15 including an annular groove 41 in which an annular flange 17 of the assembly skirt 18 may be engaged.

The applicator 10 may also include a control member 21 that is axially movable relative to the handle 15 through an opening 42 provided in a top end of said handle 15. The opening 42 may be defined by an annular rim 28.

The control member 21 may include a top wall 46 that is outwardly convex and that is extended downward, at a periphery thereof, by a skirt 29 that is slideable in the opening 42, and that is provided at a bottom thereof with two diametrally opposite pins 26. The pins 26 may serve firstly as an end-of-upward-stroke abutment for the control member 21 by coming to bear against the rim 28. The pins 26 may serve secondly to transform an axial movement of the control member 21 into a turning movement of said control member 21, for example, as described below. A convex shape of the top wall 46 makes it possible to limit an amount of friction with a user's finger.

In the exemplary embodiment shown in FIGS. 1 to 6, a connection element 22 may interconnect the stem 11 and the control member 21.

A top of the connection element 22 may be connected to the top wall 46 of the control member 21. The connection element 22 may be made integrally as a single piece with said control member 21. A bottom of the connection element 22 may include a portion 48 that is engaged in a housing 23 provided at a second end 13 of the stem 11. The second end 13 may be remote from the first end 12.

The connection element 22 and the housing 23 may include substantially complementary cross-sections that are not completely circular, so that the connection element 22 may be displaced along the axis X inside the housing 23, without being able to turn freely relative to the stem 11.

In the exemplary embodiment, the cross-sections of the connection element 22 and the housing 23 may be polygonal, for example, square, but it is not beyond the ambit of the present invention for the cross-sections to be triangular, pentagonal, star-shaped, oval, or elliptical, or even any other not-completely-circular shape.

The connection element 22 may thus be capable of turning the stem 11, while enabling the control member 21 to be displaced axially relative to the handle 15.

Means may be provided for transforming the inward movement of the control member 21 into a turning movement of said control member 21 about the axis X.

In the exemplary embodiment in FIGS. 1 to 5, the means may comprise co-operating portions in relief provided firstly in the handle 15 and secondly on the control member 21.

In the exemplary embodiment, the pins 26 may co-operate with corresponding helical threads 25 projecting from an inside surface of the handle 15, thereby causing the control member 21 to turn about the axis X while being driven into the handle 15.

A resilient return member 27 may be provided so as to return the control member 21 to an initial position thereof when the user ceases to press thereon.

In the exemplary embodiment, the resilient return member 27 may comprise a helical spring working in compression. The helical spring may come to bear at a bottom end thereof against the transverse wall 31, and may bear at a top end thereof against the top wall 46 at the bottom of a groove 32 formed between the connection element 22 and the outer skirt 29 of the control member 21. The stem wall 47 defining the housing 23 may serve to guide the return member 27.

For example, a slope of the thread and a stroke of the control member 21 may be selected so that the applicator member 14 performs between 0.5 and 2 turns when the user presses on the control member 21 and said control member 21 is displaced through a maximum stroke thereof.

The device described above may be used, for example, as shown in FIGS. 5 and 6.

Initially, the user may remove the applicator 10 from the receptacle 2. During this movement, the wiper member 3 may wipe the stem 11 and the applicator member 14 so that a substance P remains on the applicator member 14 in a quantity that is sufficient to achieve a desired makeup effect, but not excessive.

Figure 5:
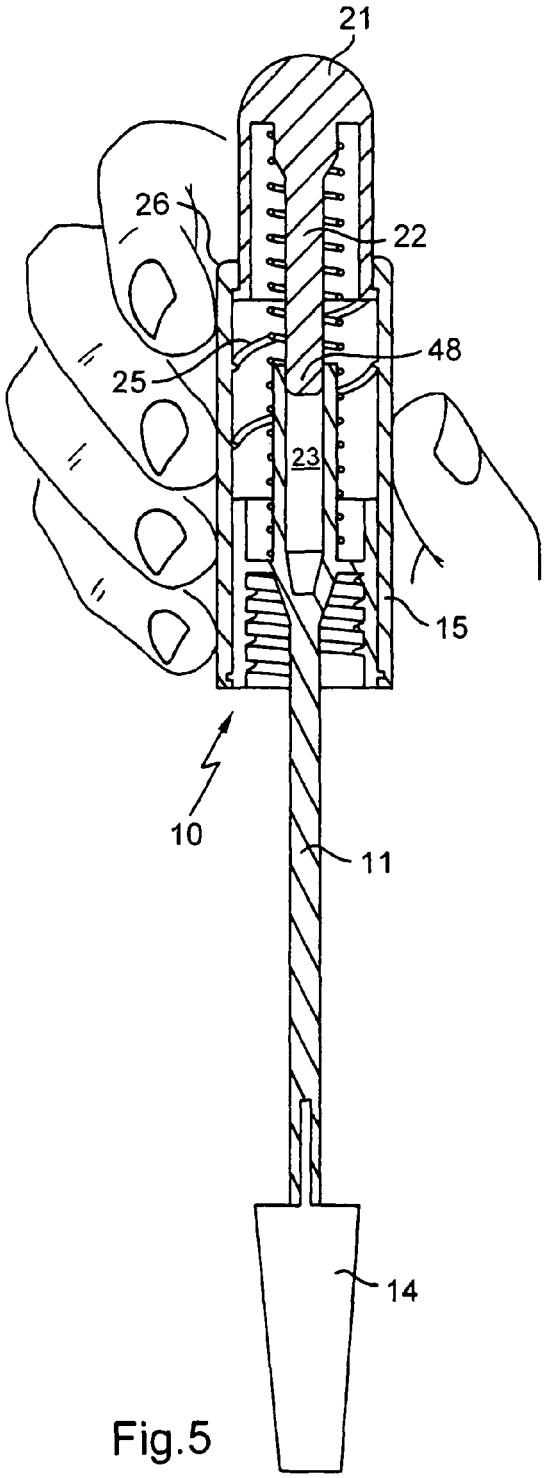
FIGS. 5 and 6 illustrate the device of FIG. 1 being used.

The user may hold the applicator 10 between her fingers by gripping the handle 15, as shown in FIG. 5.

Figure 6:
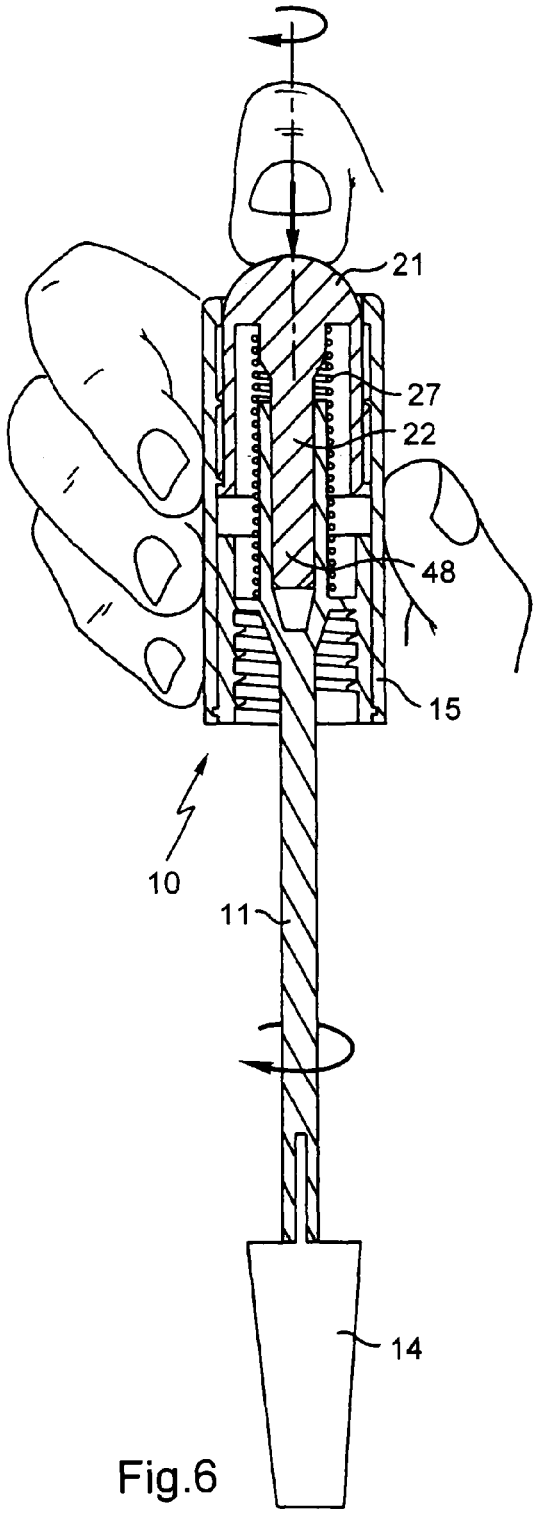

At any moment during the application of the makeup, and on one or more occasions, the user may turn the applicator member 14 about its own axis by pressing on the control member 21 with her finger, as shown in FIG. 6, for example.

When the user releases the control member 21, said control member 21 may be returned to the initial position thereof by the return member 27.

In the exemplary embodiment shown in FIGS. 1 to 6, the connection element 22 may be made integrally as a single piece with the control member 21, and said control member 21 turns when the user presses thereon, which might impede turning thereof to some extent.

It is not beyond the ambit of the present invention for the connection element 22 to be connected in some other way to the control member 21.

For example, to further improve comfort in application, the control member 21 may be made so that the control member 21 does not turn after being driven home into the handle 15.

Figure 7:
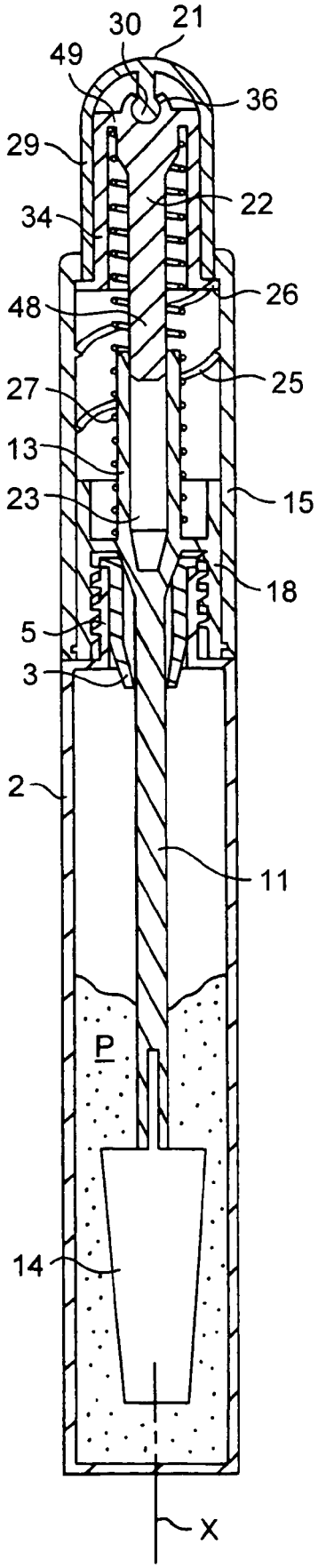
FIG. 7 is a view similar to FIG. 1 showing another exemplary embodiment.

The exemplary embodiment shown in FIG. 7 makes it possible to achieve such a result.

The exemplary device shown in FIG. 7 differs from the exemplary device described above firstly by the fact that the connection element 22 may be connected to the control member 21 by a connection that enables the connection element 22 to turn freely relative to the control member 21, and secondly by the fact that the connection element 22 may co-operate with the handle 15 so that an axial displacement of the connection element 22 is transformed into a turning movement of said connection element 22.

To this end, the connection element 22 may include a skirt 34 surrounding the portion 48 of the connection element for engaging, at least in part, in the housing 23 of the stem 11. A bottom portion of the skirt 34 may include pins 26 for co-operating with the threads 25 of the handle 15. The outer skirt 29 of the control member 21 may not include any pins, and may merely cover the skirt 34 of the connection element 22, without preventing said connection element 22 from turning.

The control member 21 may include a ball 30 that is engaged in a socket 36 formed in a top of the connection element 22. At a bottom of a groove formed between the skirt 34 and the portion 48, a top of the resilient return member 27 may bear against a transverse wall 49 via which the skirt 34 is connected to the portion 48.

When the user presses on the control member 21 and said control member 21 is driven into the handle 15, the connection element 22 may be axially displaced and the pins 26 may co-operate with the threads 25, thereby causing the connection element 22 to turn. The ball 30 may turn in the socket 36, thereby allowing the control member 21 not to turn.

The turning movement of the connection element 22 may be transmitted to the stem 11 via the portion 48 of the connection element 22 engaged in the housing 23.

Naturally, the invention is not limited to the embodiments described above.

For example, the applicator member 14 may be configured for applying make up to skin, to mucous membranes, or to nails.

In another exemplary embodiment not shown, a top of the stem 11 may include a portion that is engaged in a housing of the connection element 22 and that has a complementary cross-section that is not completely circular.

In another exemplary embodiment not shown, the resilient return member 27 may be disposed in the housing 23.

Naturally, assembling the stem 11 in the handle 15 may be achieved in some other way. For example, the assembly skirt 18 may include the groove 41 and the handle 15 may include at least the flange 17 engaged in said groove 41.

The wiper member 3 may be made in some other way, for example, with a block of foam, or may be omitted.

In another exemplary embodiment not shown, the co-operating portions in relief of the handle 15 and the control member 21 or the connection element 22 may include at least one groove formed in an insert fitted inside the handle 15.

In still another exemplary embodiment, the resilient return member 27 may be omitted.

Throughout the description, including in the claims, the term "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. An applicator comprising:

an applicator member;

a handle that is generally elongate along a longitudinal axis;

a control member that is movable relative to the handle; and a drive mechanism arranged to transform an action, exerted by a user on a the control member that is movable relative to the handle, into a turning movement of the applicator member relative to the handle over more than one fourth of a turn;

wherein the control member is movable in a direction that is substantially parallel to the longitudinal axis of the handle.

2. The applicator according to claim 1, wherein the control member projects from one end of the handle.

3. The applicator according to claim 1, further comprising a stem that carries the applicator member at a first end.

4. The applicator according to claim 3, wherein the stem is arranged to co-operate with a connection element connected to the control member.

5. The applicator according to claim 4, wherein the stem is arranged to co-operate with the connection element so as to enable relative axial displacement between the connection element and the stem, with little relative turning movement between the connection element and the stem.

6. The applicator according to claim 4, wherein the stem is arranged to co-operate with the connection element so as to enable relative axial displacement between the connection element and the stem with substantially no turning movement between the connection element and the stem.

7. The applicator according to claim 3, wherein, at a second end thereof, the stem comprises a housing including an inside section that is not completely circular, a portion of the connection element that includes a cross-section that is not completely circular being engaged in the housing of the stem.

8. The applicator according to claim 3, wherein, at a second end thereof, the stem comprises a housing including an inside section that is not completely circular, a portion of the connection element that includes a cross-section of complementary shape to the inside section being engaged in the housing of the stem.

9. The applicator according to claim 4, wherein the connection element is made integrally as a single piece with the control member.

10. The applicator according to claim 9, wherein the control member turns the stem via the connection element, which is axially displaceable relative to said stem.

11. The applicator according to claim 1, wherein the control member and the handle comprise portions in relief that co-operate so as to transform an axial movement of the control member into a turning movement of said control member.

12. The applicator according to claim 11, wherein the portions in relief comprise at least one helical thread provided on the handle and at least one pin provided on the control member so as to become engaged with the thread.

13. The applicator according to claim 12, wherein a slope of the thread and a stroke of the control member are selected so that the applicator member performs between about 0.5 and about 2 turns when the user presses on the control member and said control member is displaced through a maximum stroke thereof.

14. The applicator according to claim 1, wherein the turning movement of the applicator member is proportional to a translational movement of the control member.

15. The applicator according to claim 4, wherein the connection element is not made integrally as a single piece with the control member, but is secured to said control member using a fastener configured to enable the connection element to turn relative to the control member, without any significant axial displacement between the connection element and the control member.

16. The applicator according to claim 15, wherein the connection element is arranged to co-operate with the handle so that an axial displacement of the connection element is accompanied by said connection element turning relative to the handle, said turning movement being transmitted to the stem.

17. The applicator according to claim 3, wherein the stem is assembled to the handle so as to be able to turn relative to said handle without being axially displaced along the longitudinal axis.

18. The applicator according to claim 3, wherein the stem comprises an assembly skirt that is coaxial with the handle and that configured to be snap-fastened in said handle so as to be freely turnable about the longitudinal axis inside the handle, without being axially displaced relative to said handle.

19. The applicator according to claim 1, further comprising a resilient return member arranged to return the control member to an initial position when the user ceases to press thereon.

20. The applicator according to claim 19, wherein the resilient return member comprises a spring.

21. The applicator according to claim 20, wherein the stem comprises an assembly skirt that is coaxial with the handle and that is configured to be snap-fastened in said handle so as to be freely turnable about the longitudinal axis inside the handle, without being axially displaced relative to said handle, and wherein the spring includes a first end bearing against a transverse wall connecting the assembly skirt to a remainder of the stem.

22. The applicator according to claim 21, wherein the transverse wall comes to bear against a collar of a wiper member when a receptacle having a neck that is surmounted by the collar is closed by the applicator.

23. The applicator according to claim 1, wherein the applicator member comprises at least one of a brush, a comb, a non-twisted brush, and a twisted brush.

24. A packaging and applicator device for applying a substance onto at least one of eyelashes and eyebrows, said device comprising:

a receptacle containing the substance; and the applicator as defined in claim 1.

25. The device according to claim 24, further comprising a wiper member configured to wipe the applicator member while the applicator is being removed from the receptacle.

26. A method of applying makeup using the applicator as defined in claim 1, said method comprising:

loading the applicator member with makeup; and turning the applicator member by pressing on the control member.

27. The applicator according to claim 13, wherein the slope of the thread and the stroke of the control member are selected so that the applicator member performs about 1 turn when the user presses on the control member and said control member is displaced through the maximum stroke.

28. The applicator according to claim 1, wherein the applicator member includes a longitudinal axis and is turned about the longitudinal axis of the applicator member.

29. The applicator according to claim 1, wherein the applicator member is turned about the longitudinal axis of the handle.

* * * * *